United States Patent [19]

Polizzotti et al.

[11] 4,239,504

[45] Dec. 16, 1980

[54] FREE BASE AMINO ALCOHOLS AS ELECTROSTATIC PRECIPITATOR EFFICIENCY ENHANCERS

[75] Inventors: David M. Polizzotti, Yardley; Joe C. Steelhammer, Lansdale, both of Pa.

[73] Assignee: Betz Laboratories, Inc., Trevose, Pa.

[21] Appl. No.: 140,287

[22] Filed: Apr. 14, 1980

Related U.S. Application Data

[63] Continuation-in-part of Ser. No. 29,414, Apr. 12, 1979, abandoned.

[51] Int. Cl.[3] ..... B03C 1/00

[52] U.S. Cl. ..... 55/5

[58] Field of Search ..... 55/5, 10; 423/243, 215.5

[56] References Cited

U.S. PATENT DOCUMENTS

| | | | |
|---|---|---|---|
| 2,381,879 | 8/1945 | Chittum et al. | 55/5 |
| 2,762,505 | 9/1956 | Lawver | 209/9 |
| 3,568,404 | 3/1971 | Walker | 55/5 |
| 3,681,015 | 8/1977 | Bennett et al. | 55/5 |
| 4,043,768 | 8/1977 | Bennett et al. | 55/5 |
| 4,123,243 | 10/1978 | Vossos | 55/5 |
| 4,134,728 | 1/1979 | Libutti et al. | 55/5 |

*Primary Examiner*—Bernard Nozick

*Attorney, Agent, or Firm*—Alexander D. Ricci; Steven H. Markowitz

[57] ABSTRACT

A method is disclosed for improving operation of an electrostatic precipitator. By adding free base amino alcohol to a particle-laden gas being treated by the precipitator, the efficiency of particle removal is significantly enhanced.

20 Claims, No Drawings

FREE BASE AMINO ALCOHOLS AS ELECTROSTATIC PRECIPITATOR EFFICIENCY ENHANCERS

This application is a continuation-in-part of Ser. No. 29,414, filed Apr. 12, 1979 now abandoned, and the parent application is incorporated herein by reference.

TECHNICAL FIELD

The use of an electrostatic precipitator for removing particles from gas is indeed well known. Typically, this type of device utilizes the corona discharge effect, i.e., the charging of the particles by passing them through an ionization field established by a plurality of discharge electrodes. The charged particles are then attracted to a grounded collecting electrode plate from which they are removed by vibration or rapping.

This type of precipitator is exemplified in U.S. Pat. Nos. 3,109,720 to Cummings and 3,030,753 to Pennington.

A common problem associated with electrostatic precipitators is maximizing the efficiency of particle removal. For example, in the utility industry, failure to meet particle emission standards may necessitate reduction in power output (derating). Gas conditioning is an important method for accomplishing this goal as described in a book entitled "*INDUSTRIAL ELECTROSTATIC PRECIPITATION*" by Harry J. White, Addison-Wesley Publishing Company, Inc. (Reading, Massachusetts, 1963), p. 309. This book is incorporated herein by reference to the extent necessary to complete this disclosure.

An early patent disclosing a gas conditioning method for improving electrostatic precipitator performance is U.S. Pat. No. 2,381,879 to Chittum according to which the efficiency of removal of "acidic" particulates is increased by adding organic amine to the gas, specifically, primary amines such as methylamine, ethylamine, n-propylamine and sec-butylamine; secondary amines such as dimethylamine, diethylamine, dipropylamine and diisobutylamine; tertiary amines such as trimethylamine, triethylamine, tripropylamine and triisobutylamine; polyamines such as ethylenediamine and cyclic amines such as piperidine.

Chittum does not disclose the use of alkanolamines as gas conditioners for electrostatic precipitators. However, U.S. Pat. No. 4,123,234 to Vossos does disclose the use of what he alleges to be alkanolamine phosphate esters for that purpose and has been patented over Chittum.

DESCRIPTION OF THE INVENTION

The Vossos patent allegedly demonstrates the operability of the alkanolamine phosphate esters as electrostatic precipitator efficiency enhancers through a fly ash bulk electrical resistivity test according to which resistivity of a treated sample in a conductivity cell was determined by applying an electrode to the sample, applying voltages to the cell and measuring voltage across and current through the fly ash. The patent fails to disclose that the additives were ever tested in an electrostatic precipitator. It is doubted by the present inventors that aqueous solution chemistry as utilized in Vossos can be used to predict behavior of chemicals in the gas system found in electrostatic precipitators. In fact, when tested for efficiency enhancement in an electrostatic precipitator system, it was discovered that these compounds demonstrated little, if any, efficacy. In the tests conducted, the alkanolamine phosphate ester actually decreased efficiency.

Upon further investigation it was unexpectedly discovered that, as compared to the alkanolamine phosphate esters touted by Vossos, tested free base unneutralized amino alcohols were far superior as electrostatic precipitation efficiency enhancers. These compounds will hereinafter be referred to as free base amino alcohols, and any such reference is intended to include mixtures of such compounds.

Free base amino alcohols consist of molecules containing primary, secondary, or tertiary amines which are unneutralized, that is, they are in the basic form with an unbonded pair of electrons available for reaction. These compounds also have free hydroxyl functionalities and could, accordingly, be subjected to those reactions involving hydroxyl groups.

Quite distinctively from the above-described free base amino alcohols, the alkanolamine phosphate esters of Vossos are prepared by the reaction of alkanolamine with phosphoric acid. As a result, the amine functionality is neutralized making it no longer available to react as an amine. Also, the reaction of alkanolamine with phosphoric acid causes reaction of the alcohol functionality to form the phosphate esters, thus, reducing or eliminating the alcohol functionality present in the molecules.

Amino alcohols can be categorized as aliphatic, aromatic and cycloaliphatic. Illustrative examples of aliphatic amino alcohols are as follows:

ethanolamine
diethanolamine
triethanolamine
propanolamine
dipropanolamine
tripropanolamine
isopropanolamine
diisopropanolamine
triisopropanolamine
diethylaminoethanol
2-amino-2-methylpropanol-1
1-dimethylaminopropanol-2
2-aminopropanol-1
N-methylethanolamine
dimethylethanolamine
N,N-diisopropylethanolamine
N-aminoethylethanolamine
N-methyldiethanolamine
N-ethyldiethanolamine
N-2-hydroxypropylethylenediamine
N-2-hydroxypropyldiethylenetriamine
aminoethoxyethanol
N-methylaminoethoxyethanol
N-ethylaminoethoxyethanol
1-amino-2-butanol
di-sec-butanolamine
tri-sec-butanolamine
2-butylaminoethanol
dibutylethanolamine
1-amino-2-hydroxypropane
2-amino-1,3-propanediol
aminoethylene glycol
dimethylaminoethylene glycol
methylaminoethylene glycol
aminopropylene glycol
3-aminopropylene glycol
3-methylaminopropylene glycol 3-dimethylaminopropylene glycol
3-amino-2-butanol Illustrative examples of aromatic amino alcohols are as follows:

p-aminophenylethanol
o-aminophenylethanol
phenylethanolamine
phenylethylethanolamine
p-aminophenol
p-methylaminophenol
p-dimethylaminophenol
o-aminophenol
p-aminobenzyl alcohol
p-dimethylaminobenzyl alcohol
p-aminoethylphenol
p-dimethylaminoethylphenol
p-dimethylaminoethylbenzyl alcohol
1-phenyl-1,3-dihydroxy-2-aminopropane
1-phenyl-1-hydroxy-2-aminopropane
1-phenyl-1-hydroxy-2-methylaminopropane Illustrative examples of cycloaliphatic amino alcohols are as follows:

cyclohexylaminoethanol
dicyclohexylaminoethanol
4,4'-di(2-hydroxyethylamino)-di-cyclohexylmethane
2-aminocyclohexanol
3-aminocyclohexanol
4-aminocyclohexanol
2-methylaminocyclohexanol
2-ethylaminocyclohexanol
dimethylaminocyclohexanol
diethylaminocyclohexanol
aminocyclopentanol
aminomethylcyclohexanol Of course, the aliphatic and cycloaliphatic amino alcohols can be grouped together under the category alkanolamines.

The amount of free base amino alcohol required for effectiveness as an electrostatic precipitator efficiency enhancer (EPEE) may vary and will, of course, depend on known factors such as the nature of the problem being treated. The amount could be as low as about 1 part of active amino alcohol per million parts of gas being treated (ppm); however, about 5 ppm is a preferred lower limit. Since the systems tested required at least about 20 ppm active amino alcohol, that dosage rate represents the most preferred lower limit. It is believed that the upper limit could be as high as about 200 ppm, with about 100 ppm representing a preferred maximum. Since it is believed that about 75 ppm active amino alcohol will be the highest dosage most commonly experienced in actual precipitator systems, that represents the most preferred upper limit.

While the treatment could be fed neat, it is preferably fed as an aqueous solution. Any well known feeding system could be used, provided good distribution across the gas stream duct is ensured. Indeed, it is well known that to be effective EPEE's should be distributed across the gas stream within the ionization field of the electrostatic precipitator. For example, a bank of air-atomized spray nozzles upstream of the precipitator proper has proven to be quite effective.

If the gas temperature in the electrostatic precipitator exceeds the decomposition point of a particular amino alcohol being considered, a higher homolog with a higher decomposition point should be used. For example, in certain tests conducted, diethanolamine was not effective as an EPEE at about 620° F. but a higher homolog, such as triethanolamine, should be suitable at such temperature.

EXAMPLES

A series of tests were conducted to determine the efficacy of various amino alcohols using a pilot electrostatic precipitator system comprised of four sections: (1) a heater section, (2) a particulate feeding section, (3) a precipitator proper and (4) an exhaust section.

The heater section consists of an electric heater in series with an air-aspirated oil burner. It is fitted with several injection ports permitting the addition of a chemical and/or the formulation of synthetic flue gas. Contained within the heater section is a damper used to control the amount of air flow into the system.

Following the heater section is the particulate feeding section which consists of a 10 foot length of insulated duct work leading into the precipitator proper. Fly ash is added to the air stream and enters the flue gas stream after passing through a venturi throat. The fly ash used was obtained from industrial sources.

The precipitator proper consists of two duct-type precipitators, referred to as inlet and outlet fields, placed in series. Particulate collected by the unit is deposited in hoppers located directly below the precipitator fields and is protected from reentrainment by suitably located baffles.

The exhaust section contains a variable speed, induced-draft fan which provides the air flow through the precipitator. Sampling ports are located in the ductwork to allow efficiency determinations to be made by standard stack sampling methods.

Optical density, O.D., is a measure of the amount of light absorbed over a specific distance. Optical density is proportional to particulate concentration, C, and optical path length, L, according to:

$$O.D. = KLC,$$

where K is a constant and is a function of the particle size distribution and other physical properties of the particle.

Since optical density is directly proportional to particulate concentration it may be used to monitor emissions. Accordingly, an optical density monitor located in an exit duct of an electrostatic precipitator would monitor particulate emissions with and without the addition of chemical treatments to the gases. Treatments which increase the efficiency of a unit would result in decreased dust loadings in the exit gas. This would be reflected by a decrease in O.D. To ensure reproducibility of results, particulate size distribution and other particulate properties, such as density and refractive index, should not change significantly with time.

Accordingly, in the tests conducted, a Lear Siegler RM-41 optical density monitor located in the exit ductwork was used to evaluate precipitator collection performance.

The use of the pilot electrostatic precipitator and optical density monitor for evaluating the efficacy of a chemical treatment as an EPEE is illustrated below in Example 1.

EXAMPLE 1

Fly ash produced as the combustion by-product of an approximately 1% sulfur coal was found to have a resistivity of $10^{11}$ ohm-cm at 300° F. Utilizing this ash type and a flue gas similar to that of an industrial utility plant, pilot electrostatic precipitator studies were performed to determine whether or not a gas conditioning agent could enhance the collection efficiency. The results of the trial are presented in Table 1.

TABLE 1

RESULTS OF FLUE GAS CONDITIONING STUDY PERFORMED IN LOW SULFUR SIMULATION

| Parameter | Test #1 | Test #2 |
|---|---|---|
| Chemical Feed Rate, ppm | 0 | 66 |
| Inlet Mass Loading, gr/scf | 4.1605 | 4.1605 |
| Outlet Mass Loading, gr/scf | .2314 | .0212 |
| % Efficiency | 94.44 | 99.49 |
| Optical Density Baseline | .175 | .166 |
| Optical Density After Treatment | — | .026 |
| % Reduction in Optical Density | — | 84.34 |

As seen in Table 1, the chemical additive at 66 ppm effected an increase in precipitator efficiency of from 94.44% to 99.49%. The significantly enhanced efficiency is also reflected by the 84.3% reduction in optical density.

EXAMPLE 2

TABLE 2-continued

CHARACTERIZATION OF FLY ASH SAMPLES

| Fly Ash Designation | I | II | III | IV |
|---|---|---|---|---|
| Aluminum as $Al_2O_3$ | 18 | 17 | 19 | 16 |
| Silicon as $SiO_2$ | 57 | 48 | 66 | 63 |
| Calcium as CaO | 3 | 1 | 1 | — |
| Iron as $Fe_2O_3$, $Fe_3O_4$ | 16 | 10 | 6 | 8 |
| $K_2O$ | 2 | 1 | 2 | 1 |
| $TiO_2$ | | 2 | 1 | |
| Equilibrium pH slurry | 6.9 | 6.6 | 8.4 | 11.7 |

The results of the tests evaluating the efficacy of various amino alcohols are reported below in Table 3 in terms of % decrease in optical density (% d.O.D.). The various fly ash designations are taken from Table 2. The column headed "Fly Ash Content" is the amount of fly ash in the gas in grains per actual cubic foot (gr/ACF). Gas flow rates in the pilot precipitator are reported as actual cubic feet per minute at 310° F., and the $SO_2$ and $SO_3$ reported are the respective amounts contained in the gas in terms of parts per million parts of gas. The $H_2O$ is approximate volume % in the gas. The chemical feed rates are parts of active treatment per million parts of gas.

TABLE 3

EVALUATION OF AMINO ALCOHOLS AS ELECTROSTATIC PRECIPITATOR EFFICIENCY ENHANCERS

| Treatment | Dosage (ppm) | Fly Ash | Fly Ash Content | Gas Flow Rate (ACFM) | $SO_2$ (ppm) | $SO_3$ (ppm) | $H_2O$ (%) | % d.O.D. |
|---|---|---|---|---|---|---|---|---|
| N,N diethylethanolamine | 61 | II | 3.40 | 152 | 726 | — | 2 | 42 |
| | 94 | II | 3.40 | 152 | 726 | — | 2 | 65 |
| | 47 | III | 8.87 | 154 | 451 | — | 2 | 93 |
| methylethanolamine | 50 | II | 3.40 | 151 | 590 | — | 2 | 85 |
| | 100 | II | 3.40 | 151 | 0 | — | 2 | 64 |
| N-aminoethylethanolamine | 55 | II | 3.40 | 151 | 726 | — | 2 | 72 |
| | 41 | III | 8.87 | 154 | 451 | 10 | 2 | 64 |
| diethanolamine | 116 | II | 3.40 | 151 | 726 | — | 2 | 85 |
| | 55 | III | 4.84 | 152 | 750 | — | 2 | 99 |
| | 43 | III | 4.84 | 152 | 750 | — | 3.4 | 93 |
| | 96 | III | 4.84 | 152 | 313 | — | 1.5 | 86 |
| | 43 | III | 4.84 | 154 | 726 | — | 2 | 90 |
| Triethanolamine | 63 | I | 8.58 | 145 | 476 | 10 | 1.6 | 50 |
| | 47 | I | 8.58 | 145 | 476 | 10 | 1.6 | 50 |
| monoethanolamine | 70 | III | 4.80 | 154 | 726 | — | — | 80 |
| | 40 | III | 9.64 | 142 | 489 | 11 | 2 | 93 |

The amino alcohols were tested for EPEE activity using several different industrial fly ashes. The various fly ashes were characterized by known standard slurry analysis, and x-ray fluorescence and optical emission spectra with the following results as reported in Table 2.

TABLE 2

CHARACTERIZATION OF FLY ASH SAMPLES

| Fly Ash Designation | I | II | III | IV |
|---|---|---|---|---|
| % Sulfur in coal | 1-4 | 1-1.2 | 1.0-1.5 | 0.5 |
| Resistivity (ohm-cm) | $10^{10}$ | $\leq 10^7$ | $5 \times 10^{11}$ | $7.6 \times 10^{10}$ |
| SLURRY ANALYSIS: | | | | |
| Calcium as Ca, ppm | 27 | 14 | 13 | 97 |
| Magnesium as Mg, ppm | 1.2 | 11 | 7 | |
| Sulfate as $SO_4$, ppm | 92 | 67 | 44 | 56 |
| Chloride as Cl, ppm | | .6 | | .6 |
| Total Iron as Fe, ppm | | .05 | .05 | .10 |
| Soluble Zinc as Zn, ppm | | | .10 | |
| Sodium as Na, ppm | 1.6 | 3.5 | 5.9 | 3.6 |
| Lithium as Li, ppm | <.1 | <.1 | .2 | .6 |
| INORGANIC ANALYSIS: | | | | |
| (Weight %) | | | | |
| Loss on ignition | 3 | 21 | 4 | 3 |
| Phosphorous, $P_2O_5$ | 1 | 1 | — | 1 |
| Sulfur as S, $SO_2$, $SO_3$ | — | 1 | — | 1 |
| Magnesium as MgO | — | — | 1 | 1 |

As can be seen from Table 3, the amino alcohols were effective as electrostatic precipitator efficiency enhancers. While the compounds tested were alkanolamines, it is believed that amino alcohols as a class would be effective for the purpose. Also, while the test gas contained fly ash and $SO_2$, which are conditions typically found in coal-fired boilers, it is believed that the EPEE's according to the present invention would be effective in other gas systems where particulate matter is to be removed by an electrostatic precipitator.

As a result of these tests, diethanolamine, being the most active compound, is considered to be the most preferred additive.

EXAMPLE 3

To provide a comparison with a phosphate ester according to the above-noted Vossos Patent, diethanolamine was tested for EPEE efficacy as was diethanolamine phosphate ester made according to the patent.

In preparing the alleged ester, 0.435 mole of phosphoric acid was reacted with 0.435 mole of diethanolamine to yield an equimolar mixture. After allowing approximately 1.35 hours of reaction time, the material was tested.

The results of these tests are reported below in Table 4 in terms of reduction in O.D. (% d.O.D.). The fly ash used was fly ash IV from Table 2.

TABLE 4

EVALUATION OF AMINO ALCOHOLS AS ELECTROSTATIC PRECIPITATOR EFFICIENCY ENHANCERS

| Treatment | Dosage (ppm) | Fly Ash Content (gr/ACF) | Gas Flow* Rate (ACFM) | $SO_2$ (ppm) | $SO_3$ (ppm) | $H_2O$ (%) | .O.D. | % d.O.D. |
|---|---|---|---|---|---|---|---|---|
| None | — | 2.90 | 152 | 400 | 2 | 2 | 0.80 | — |
| diethanolamine phosphate ester | 64.9 | 2.90 | 152 | 400 | 2 | 2 | 0.94 | −17 |
| diethanolamine | 56 | 2.90 | 152 | 400 | 2 | 2 | 0.06 | 94 |

*at 310° F.

As can be seen from Table 4, the diethanolamine was far superior to the diethanolamine phosphate ester as an EPEE. The negative % d.O.D. value for the phosphate ester run meant that the particle collection efficiency of the pilot precipitator was actually decreased by this compound.

Results of field trials conducted at a utility plant confirm the above-reported EPEE efficacy studies.

Industrial boiler systems commonly include the boiler proper and heat exchanger means to receive hot combustion gas from the boiler. The heat exchanger can be either an economizer, which uses the combustion gas to heat boiler feedwater, or an air preheater, used to heat air fed to the boiler. In either case, the heat exchanger acts to cool the combustion gas.

The most widely used boiler fuels are oil or coal, both of which contain sulfur. Accordingly, the combustion gas can contain sulfur trioxide which reacts with moisture in the combustion gas to produce the very corrosive sulfuric acid. Since the corrosive effects are, indeed, quite evident on metal surfaces in the heat exchanger equipment, cold-end additive treatments are injected into the combustion gas upstream of the economizer or air preheater to reduce corrosion.

If a boiler is coal-fired, electrostatic precipitator equipment is sometimes provided downstream of the heat exchanger to remove fly ash and other particles from the combustion gas. To improve the efficiency of particle collection, electrostatic precipitation efficiency enhancers are typically added to the combustion gas at a location between the heat exchanger means and the precipitator, that is, downstream of the heat exchanger means.

Based on economic and/or efficacy considerations, it may be desirable to blend various amino alcohols for optimization purposes.

It is understood that the amino alcohol can be fed directly or formed in the gas stream, e.g., a decomposition product.

Having thus described the invention, what is claimed is:

1. In an electrostatic precipitator, a method for removing particles from a particle-laden gas stream which method comprises electrically charging the particles by passing the gas stream through an ionization field and attracting the thus-charged particles to a grounded collecting electrode for collection, the improvement comprising: prior to collection of the particles distributing across the gas stream within the ionization field from about 1 to 200 parts of effective free base amino alcohol additive per million parts of gas to enhance the efficiency of particle removal.

2. The method of claim 1, wherein said additive is added as an aqueous solution.

3. The method of claim 1 or 2, wherein said additive is free base alkanolamine.

4. The method of claim 3, wherein said additive is sprayed into said gas stream.

5. The method of claim 4, wherein said additive is added in an amount of from about 5 to about 100 parts of active additive per million parts of gas.

6. In an electrostatic precipitator, a method for removing particles from a particle-laden combustion gas stream of a boiler system fired by sulfur-containing coal which method comprises electrically charging the particles by passing the gas stream through an ionization field and attracting the thus-charged particles to a grounded collecting electrode for collection, the improvement comprising: prior to collection of the particles distributing across the gas stream within the ionization field from about 1 to about 200 parts of effective free base amino alcohol additive per million parts of gas to enhance the efficiency of particle removal.

7. In an electrostatic percipitator, a method for removing particles from a particle-laden combustion gas stream of a boiler system fired by sulfur-containing coal which method comprises electrically charging the particles by passing the gas stream through an ionization field and attracting the thus-charged particles to a grounded collecting electrode for collection, the improvement comprising: prior to collection of the particles distributing across the gas stream within the ionization field from about 1 to about 200 parts of effective free base alkanolamine additive per million parts of gas to enhance the efficiency of particle removal.

8. The method of claim 7, wherein said additive is added as an aqueous solution.

9. The method of claim 8, wherein said additive is added in an amount of from about 5 to about 100 parts of active additive per million parts of gas.

10. In an electrostatic precipitator, a method for removing particles from a particle-laden gas stream containing fly ash which method comprises electrically charging the particles by passing the gas stream through an ionization field and attracting the thus-charged particles to a grounded electrode for collection, the improvement comprising: prior to collection of the particles distributing across the gas stream within the ionization field from about 1 to about 200 parts of effective free base amino alcohol additive per million parts of gas to enhance the efficiency of particle removal.

11. The method of claim 10, wherein said additive is added as an aqueous solution.

12. The method of claim 10, wherein said gas stream is the combustion gas of a boiler system fired by sulfur-containing coal.

13. The method of claim 10 or 12, wherein the gas stream also contains sulfur dioxide.

14. In an electrostatic precipitator, a method for removing particles from a particle-laden gas stream which contains fly ash which method comprises electrically charging the particles by passing the gas stream through an ionization field and attracting the thus-charged particles to a grounded electrode for collection, the improvement comprising: prior to collection of the particles distributing across the gas stream within the ionization field from about 1 to about 200 parts of effective free base alkanolamine per million parts of gas to enhance the efficiency of particle removal.

15. The method of claim 14, wherein said gas stream is the combustion gas of a boiler system fired by sulfur-containing coal.

16. The method of claim 14 or 15, wherein said additive is added as an aqueous solution.

17. The method of claim 16, wherein said gas stream also contains sulfur dioxide.

18. The method of claim 1, 6, 10, 11 or 12, wherein said additive is water-soluble, aliphatic alkanolamine.

19. The method of claim 1, 7, 10, 11 or 12, wherein said additive is at least one member selected from the group consisting of monoethanolamine, diethanolamine, triethanolamine, methylethanolamine, N-aminoethylethanolamine and N,N-diethylethanolamine.

20. The method of claim 19, wherein said additive is diethanolamine.

* * * * *